US010703535B2

(12) United States Patent
Dag

(10) Patent No.: US 10,703,535 B2
(45) Date of Patent: Jul. 7, 2020

(54) PACKAGING ELEMENT CONSTRUCTED FROM FOLDED BLANK

(71) Applicants: GOERNER FORMPACK GMBH, Klagenfurt (AT); Papacks Sales GmbH, Cologne (DE)

(72) Inventor: Tahsin Dag, Cologne (DE)

(73) Assignees: Papacks Sales GmbH, Cologne (DE); Goerner Formpack GmbH, Klagenfurt (AT)

( * ) Notice: Subject to any disclaimer, the term of this patent is extended or adjusted under 35 U.S.C. 154(b) by 59 days.

(21) Appl. No.: 15/738,665

(22) PCT Filed: Jun. 13, 2016

(86) PCT No.: PCT/EP2016/063490
§ 371 (c)(1),
(2) Date: Mar. 16, 2018

(87) PCT Pub. No.: WO2016/207007
PCT Pub. Date: Dec. 29, 2016

(65) Prior Publication Data

US 2018/0265251 A1 Sep. 20, 2018

(30) Foreign Application Priority Data

Jun. 22, 2015 (DE) ..... 20 2015 103 276 U

(51) Int. Cl.
*B65D 21/032* (2006.01)
*B65D 21/02* (2006.01)
(Continued)

(52) U.S. Cl.
CPC ..... *B65D 21/023* (2013.01); *B65D 5/001* (2013.01); *B65D 5/0015* (2013.01); *B65D 5/5038* (2013.01); *B65D 2585/6842* (2013.01)

(58) Field of Classification Search
CPC ..... B65D 21/0233; B65D 21/0209; B65D 21/023; B65D 5/001; B65D 5/5038
See application file for complete search history.

(56) References Cited

U.S. PATENT DOCUMENTS 4,436,243 A 3/1984 Nason et al.
6,431,436 B1 8/2002 Evers
(Continued)

FOREIGN PATENT DOCUMENTS

DE 87 09 277.8 U1 10/1988
DE 200 08 952 U1 11/2000
(Continued)

*Primary Examiner* — Stephen J Castellano
(74) *Attorney, Agent, or Firm* — Muirhead and Satumelli, LLC

(57) ABSTRACT

A packaging element for accommodating at least one product. The packaging element may include a blank which has the following portions connected to one another by folding lines: an accommodating portion having at least one receptacle, the shape of which is matched to the shape of a product to be accommodated; a first side-wall portion; a first cover-wall portion; a second side-wall portion; and a second cover-wall portion. The first cover-wall portion may have at least one hollow, and the second cover-wall portion may have at least one protrusion with a shape and position complementary to the hollow.

10 Claims, 7 Drawing Sheets

(51) Int. Cl.
*B65D 5/50* (2006.01)
*B65D 5/00* (2006.01)

(56) References Cited

U.S. PATENT DOCUMENTS

| | | | | |
|---|---|---|---|---|
| 2011/0168599 | A1 | 7/2011 | Koenig et al. | |
| 2013/0334234 | A1 | 12/2013 | Vernon et al. | |
| 2014/0113789 | A1* | 4/2014 | Aganovic ..... | B65D 21/023 493/162 |
| 2017/0305596 | A1 | 10/2017 | Dag | |

FOREIGN PATENT DOCUMENTS

| | | | |
|---|---|---|---|
| DE | 101 02 239 | A1 | 4/2002 |
| DE | 602 22 153 | T2 | 6/2008 |
| DE | 10 2012 201 882 | A1 | 8/2013 |
| DE | 20 2014 105 771 | U1 | 2/2015 |
| DE | 20 2015 100 997 | U1 | 4/2015 |
| DE | 20 2015 103 273 | U1 | 8/2015 |
| EP | 1 431 210 | B1 | 8/2007 |
| EP | 1 776 290 | B1 | 4/2011 |
| EP | 2 313 321 | B1 | 2/2012 |
| GB | 2 414 728 | A | 12/2005 |
| WO | WO 99/42374 | | 8/1999 |
| WO | WO 2009/021275 | A1 | 2/2009 |
| WO | WO 2010/147667 | A1 | 12/2010 |

* cited by examiner

PACKAGING ELEMENT CONSTRUCTED FROM FOLDED BLANK

TECHNICAL FIELD

The system described herein relates to a packaging element and more particularly to a packaging element for accommodating at least one product.

BACKGROUND

A packaging element may include a blank which has the following portions connected to one another by folding lines:

- an accommodating portion having at least one receptacle, the shape of which is matched to the shape of a product to be accommodated;
- a first side-wall portion;
- a first cover-wall portion;
- a second side-wall portion;
- a second cover-wall portion.

The blank consists in particular of paperboard, board or the like flat fiber material, which for example can be produced as a molding by pulp molding. Here, the term "blank" merely designates a one-piece element of thin fiber material which has not necessarily been produced by cutting but instead can be formed by a molded pulp process, for example.

For the dispatch of books, for example, use is made of board blanks in which the accommodating portion has a receptacle delimited by covering flaps. A book is laid between the covering flaps and the covering flaps are folded over the book. Then, along the folding lines, the first side-wall portion, the first cover-wall portion, the second side-wall portion and the second cover-wall portion are each folded through 90° toward each other, so that they form a closed parallelepiped. The second cover-wall portion rests on the side of the accommodating portion that faces away from the book, and is stuck to said portion.

There is a desire to configure such packaging elements to be more esthetically pleasing and capable of better stacking.

SUMMARY OF THE INVENTION

Described herein is a packaging element having a first cover-wall portion that has at least one hollow, and a second cover-wall portion that has at least one protrusion with a shape and position complementary to the hollow.

In some embodiments, one side of the packaging element, in particular the upper side, is provided with at least one protrusion, and the other side, primarily the underside, is provided with at least one hollow, into which a protrusion arranged on the upper side of a second identically shaped packaging element can be inserted. However, the protrusions can also be arranged on the underside and the hollows on the upper side. It is also possible both to arrange one or more protrusions on the underside with complementary hollows on the upper side and also to arrange one or more protrusions on the upper side with complementary hollows on the underside. In some embodiments, protrusions and hollows should be arranged such that, in the case of two stacked identically shaped packaging elements, the protrusions and hollows on the upper side of the lower packaging element project into hollows and protrusions on the underside of the upper packaging element. If the protrusions are arranged on the underside of the packaging element, they can form stable supporting surfaces, so that the packaging element can be placed on the protrusions in a stable manner.

In this way, the packaging element can be stacked optimally and in a manner secure against displacement. The protrusion which, for example, is arranged on the cover-wall of the lower packaging element, projects into the complementary hollow on the bottom of the upper packaging element and prevents the stacked packaging elements slipping relative to each other. The protrusion can be of any desired shape and, for example, form symbols such as letters and numbers and also logos or illustrations of the packaged products. Such a protrusion may enhance the optical appearance of the container and serves at the same time as a transport safeguard.

In some embodiments, the packaging element has the product receptacles in the accommodating portion, the two cover-wall portions and the two side-wall portions formed from a blank, the different portions of which are connected via folding lines. The folding lines can in practice extend parallel to one another. The blank made of pulp fibers is simple and inexpensive to produce and simple to handle and dispose of. As explained further below, the blank can have additional accommodating portions and side-wall portions.

As mentioned herein, in practice the accommodating portion can be enveloped by the two side-wall portions and the two cover-wall portions by folding along the folding lines. In practice, the first cover-wall portion and the second cover-wall portion can extend in mutually parallel planes, so that the packaging elements can be stacked securely. The side-wall portions do not necessarily have to be parallel. They can extend obliquely, so that, in side view, the packaging element is given the shape of a flat trapezoid or parallelogram.

In practice, the at least one protrusion and the at least one hollow can have complementary shapes and be provided at mutually corresponding positions, so that the underside of a second identically shaped packaging element can be laid flush on the upper side of a packaging element, the protrusion on the upper side of the lower packaging element projecting into the complementarily shaped hollow on the underside of the upper packaging element. In some embodiments, if multiple protrusions are provided on the upper side, then the underside has hollows with corresponding shapes and positions, so that when two identically shaped packaging elements are stacked, a respective protrusion projects into a respective hollow. As mentioned, alternatively or additionally, protrusions can be arranged on the underside and hollows on the upper side.

In practice, the packaging element can have at least one of the following features:

- the at least one protrusion of the upper side has the shape of a symbol, in particular a logo, a number or a letter;
- the at least one protrusion has the shape of a product accommodated in the container.

In some embodiments in particular, company logos, company names but also illustrations of the products in a three-dimensional configuration, promoting sales, are suitable for decorating the packaging element with simultaneous stabilization of a stack of such elements.

In practice, the accommodating portion and/or the cover-wall portion resting thereon can have a closure element, with which the accommodating portion and the cover-wall portion resting thereon can be connected. In the simplest case, at least one portion of a two-sided adhesive tape is arranged between the two portions, bonding the latter. However, it is also possible for two magnetic elements or a magnetic element and an iron-containing element to be attached to the two portions at mutually corresponding positions, so that these elements attract each other. Any desired other closure devices, such as closure flaps which are inserted into slots, or hook-and-loop fasteners, can be used to connect an accommodating portion and a cover-wall portion resting thereon.

In practice, the packaging element can be produced from molded pulp. Molded pulp is an environmentally friendly board material made of pulp fibers, which can be obtained from renewable and biodegradable raw materials and also from waste paper. Beer mats and egg cartons are usually also made from molded pulp. Molded pulp can be molded in very different shapes and is particularly well suited to making complex shapes from pulp fibers economically. However, it is also possible to produce the packaging element from paper material or board material in the deep-drawing process. The deep-drawing of paper or board is known, for example, from the document DE 10 2012 201 882 A1. Both in the case of molded pulp and in the deep-drawing process, the packaging element can consist of pulp fibers of any desired color. In this way, a very attractive visual effect can be achieved.

In practice, the packaging element can have at least one additional accommodating portion with at least one receptacle. At least one folding line can extend between the first accommodating portion and the additional receptacle. In practice, the additional accommodating portion can rest on the accommodating portion. Thus, multiple accommodating portions can be arranged above one another, each accommodating the product to be packaged, accessories for the product or information materials such as operating instructions, proofs of authenticity, etc. A side-wall portion, which extends only over part of the height of the side wall, can extend between the first cover-wall portion and the first accommodating portion. Two accommodating portions folded back onto each other then follow. An additional side-wall portion can adjoin the additional accommodating portion, extending over the remaining part of the height of the side wall. It is also possible for further division of the height of the packaging element to be provided by a second additional accommodating portion.

The receptacles for the objects to be accommodated do not necessarily have to surround these objects in the form of a hollow. The object can, for example, also be accommodated in that the receptacle is formed as a protrusion and the object to be accommodated is pushed onto the receptacle, for example if the object has the shape of a ring or of a closed hoop.

The packaging element can also be inserted into a box-like holding carton having a lid. The upper side of the lid can have at least one hole, the shape and position of which corresponds to the shape and the position of the at least one protrusion of the adjacent cover-wall portion. The underside of the holding carton can have a hole, the shape and position of which corresponds to the shape and the position of the at least one hollow of the adjacent cover-wall portion. The outer walls of the holding carton can be configured or printed in a different color than the packaging element, so that a very attractive packaging carton, which can be stacked, easily results. As mentioned, the protrusions can also be on the underside of the packaging element and the hollows on its upper side, corresponding holes being formed in the upper side and underside of the holding carton.

In practice, the protrusions can project by at least approximately 2 mm out of the surface of the upper side, the hollows accordingly being at least approximately 2 mm deep. In this way, an effective safeguard against slipping is formed. However, the height of the protrusions can also be considerably greater, given a correspondingly greater depth of the hollow. In addition, the base of the hollow does not have to extend flat, so that protrusion and hollow have an inclined or curved profile of the base surfaces opposite each other.

BRIEF DESCRIPTION OF DRAWINGS

In the following description, illustrative embodiments of the packaging container according to the system described herein will be described in more detail with reference to the drawings, in which.

DETAILED DESCRIPTION OF VARIOUS EMBODIMENTS

Figure 1:
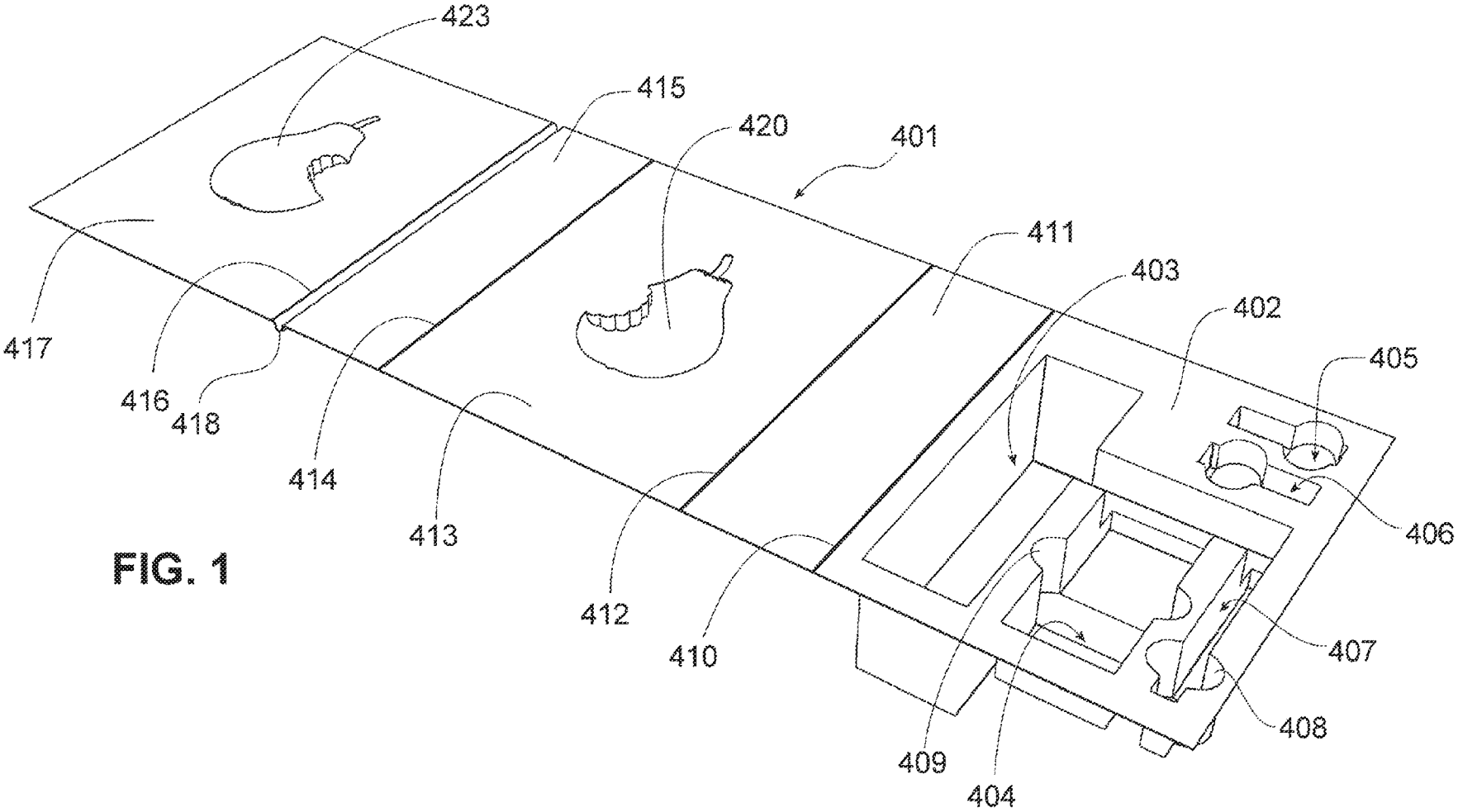
FIG. 1 shows a three-dimensional plan view of a blank which can be folded to form a packaging element, according to some embodiments of the system described herein.

FIGS. 1-4 show a blank 401 which forms a packaging element 419 having multiple receptacles for products to be inserted therein. The blank 401 is made of, e.g., consists of, pulp and has an accommodating portion 402. The accommodating portion 402 has multiple receptacles 403-407, which can each accommodate a product to be inserted. Each of the receptacles 403-407 is formed as a shell-like depression, into which the products can be laid. The receptacles 403-407 merge partly into one another. It is important that the walls of the receptacles 403-407 fix the product to be inserted therein in at least a point-by-point manner. The receptacle 403 is intended for a mobile phone, for example. The receptacle 404 can be intended for the power unit of the mobile phone. The receptacle 405 can be intended for a headset or power plug. The same is true of the receptacle 406. The receptacle 407 can be intended for a power cable. The shape and arrangement of the receptacles 403-407 can be matched in any desired way to the purpose of the respective packaging. It should be noted that the contours of the receptacles 403-407 do not have to correspond exactly to the contours of the products to be accommodated. Widened regions 408, 409, which make it easier to grip and remove the accommodated products, can be seen in FIG. 1.

The accommodating portion 402 is connected via a first folding line 410 to a first side-wall portion 411. Via a second folding line 412, a first cover-wall portion 413, in the center of which a hollow 420 in the shape of a bitten pear is formed, adjoins the first side-wall portion 411. The first cover-wall portion 413 merges via a third folding line 414 into the second side-wall portion 415. A fourth folding line 416 and a second cover-wall portion 417 adjoin the second side-wall portion 415. The second cover-wall portion 417 has the protrusion 423, which has a shape complementary to the hollow 420.

Figure 3:
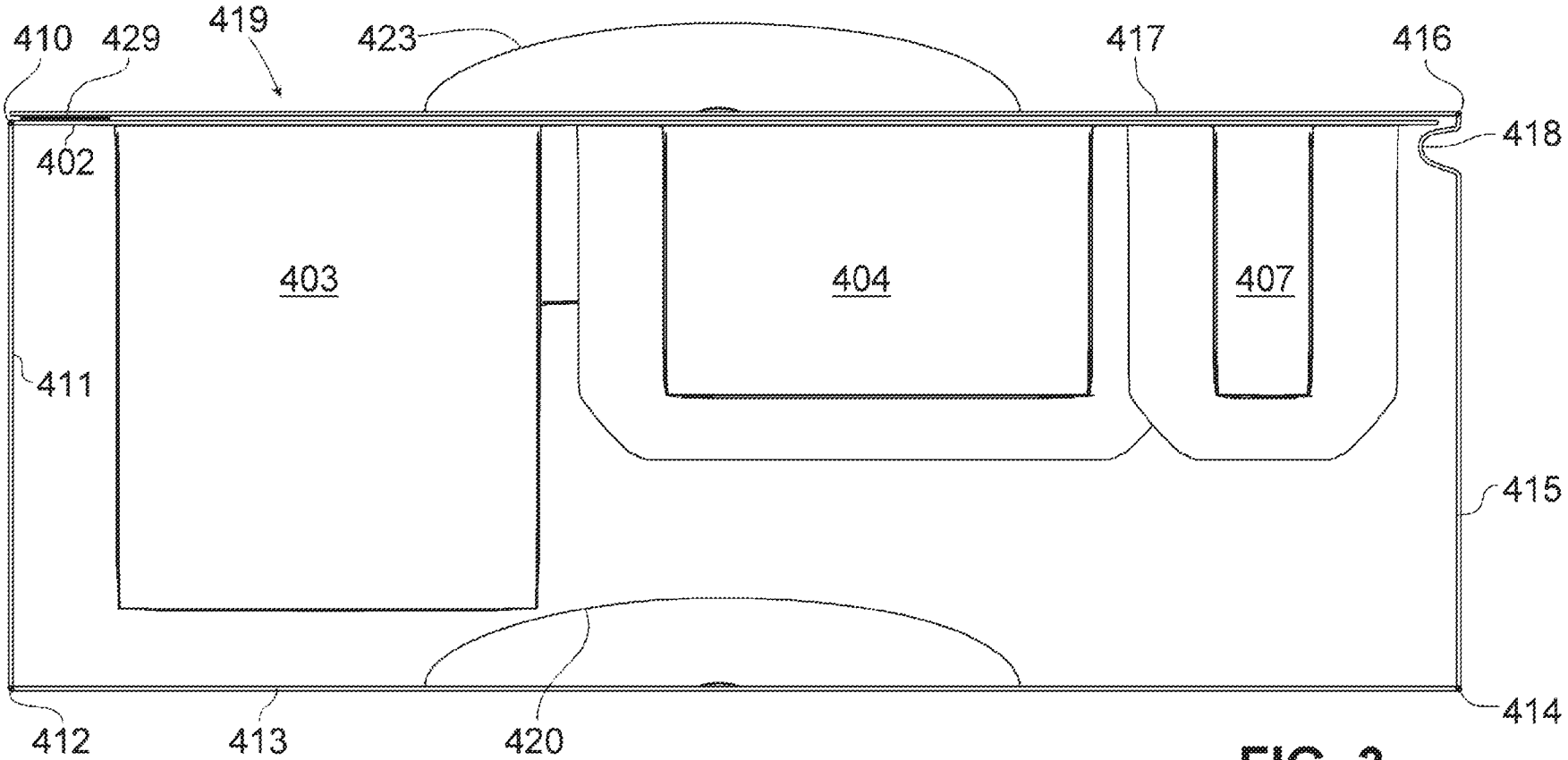
FIG. 3 shows a side view of the blank folded to form a packaging element, according to some embodiments of the system described herein.

In some embodiments, all the folding lines extend parallel to one another. At all the folding lines, the adjacent wall portions are folded through 90° toward one another, so that when folded along all the folding lines, the cube-like packaging element 419 that can be seen in FIG. 3 is produced. As mentioned above, however, embodiments are also possible in which the folding angle differs from 90° and the packaging element that is produced can have the cross section of a flat trapezoid or a flat parallelogram.

The packaging element 419 illustrated in FIG. 3 is cube-like. A connecting element 429, in the present case a two-sided adhesive strip, is arranged between the second cover-wall portion 417 and the accommodating portion 402 parallel thereto and connects these two portions to each other. It should be noted that other connecting elements, for example magnetic connecting elements or flaps of the blank, can be used in order to connect these two portions 417 and 402 to each other.

Alternatively or additionally, the packaging element 419 can be inserted into a box-like holding carton 422, the lower wall of which has a hole 421 which is matched to the hollow 420 and the contour of which corresponds to the contour of the hollow 420. In the bottom view, the hole has the same position as the hollow 420. The packaging element 417 inserted into the holding carton 422 can be seen in FIG. 4. Both the holding carton 422 and the lid 425 are illustrated as sectioned in the center, so that the packaging element 419 is visible. The lid 425, in the upper side 427 of which there is formed a hole 424, the contour of which substantially corresponds to the contour of the protrusion 423, is put on from above. The holding carton 422 also has a hole 426 on the underside 428, which in contour and position corresponds to the contour and position of the hollow 420. The lid 425 and the holding carton 422 form the outer side of the packaging container 400 from FIG. 4, except in the region of the protrusion 423 and the hollow 420.

Figure 2:
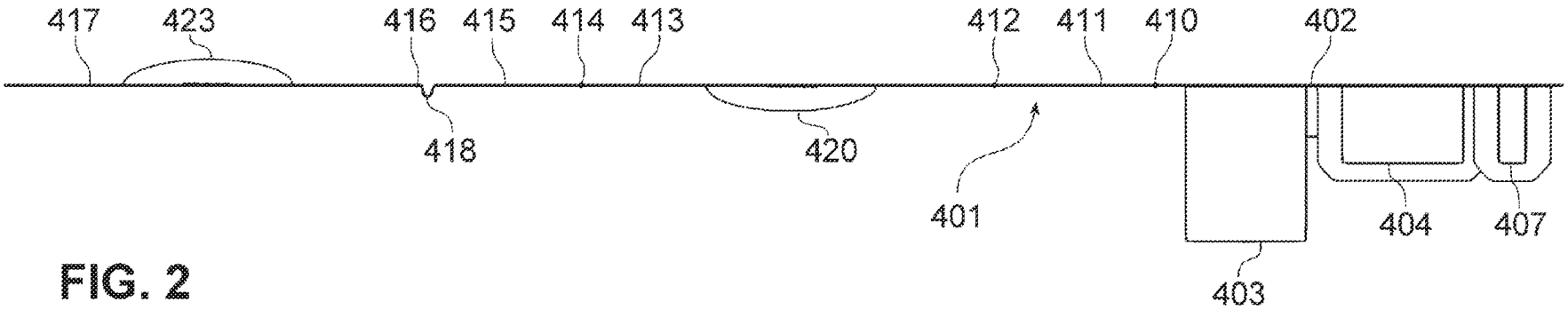
FIG. 2 shows a side view of the blank from FIG. 1, according to some embodiments of the system described herein.
Figure 4:
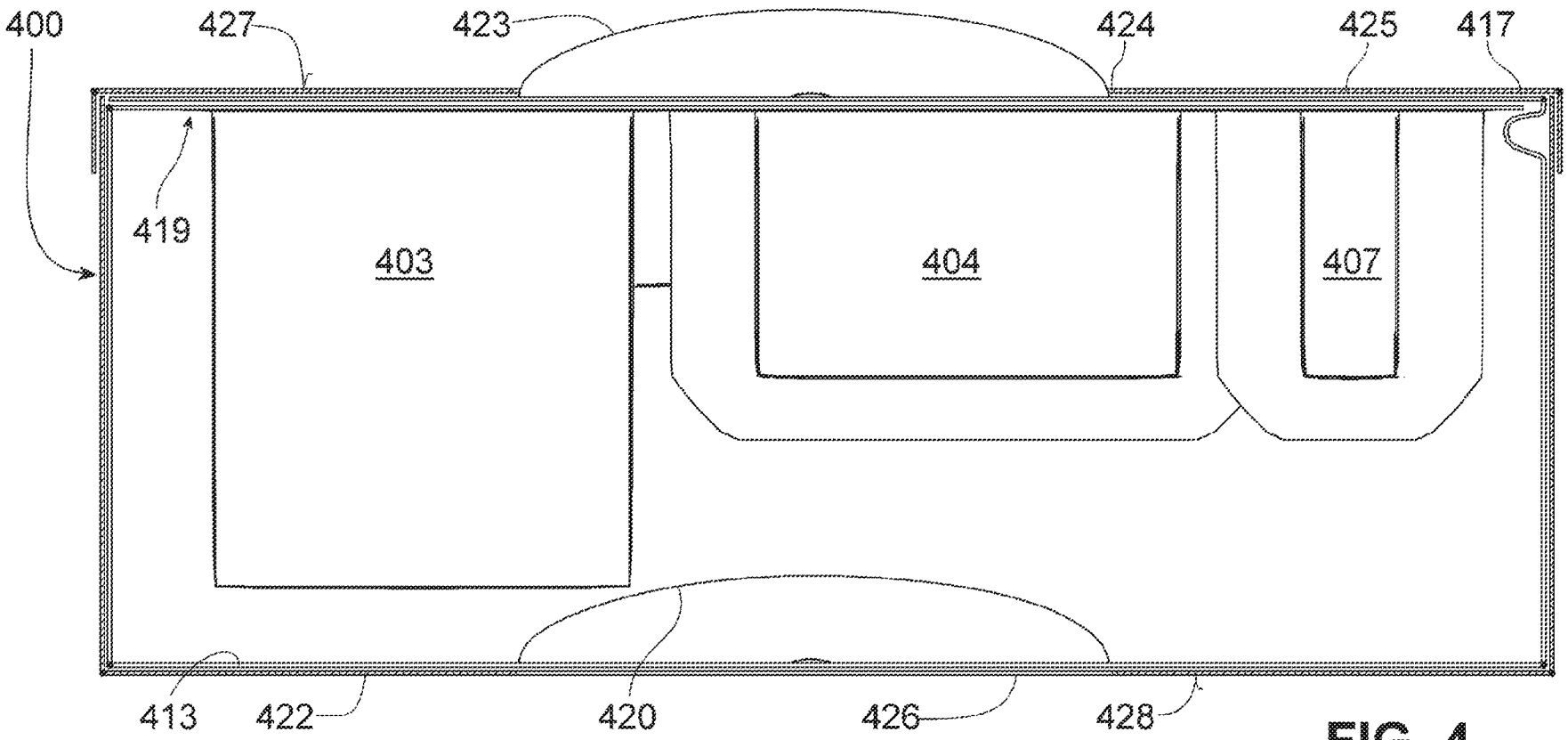
FIG. 4 shows the packaging element from FIG. 3 when it is inserted into a box-like holding carton with a lid, wherein holding carton and lid are sectioned in the center, according to some embodiments of the system described herein.

In FIGS. 2-4 it can be seen that a curved relieving portion 418, with which dimensional inaccuracies of the blank 401 can be compensated, is arranged close to the fourth folding line 416.

In practice, the blank can be formed from molded pulp, as mentioned.

Figure 5:
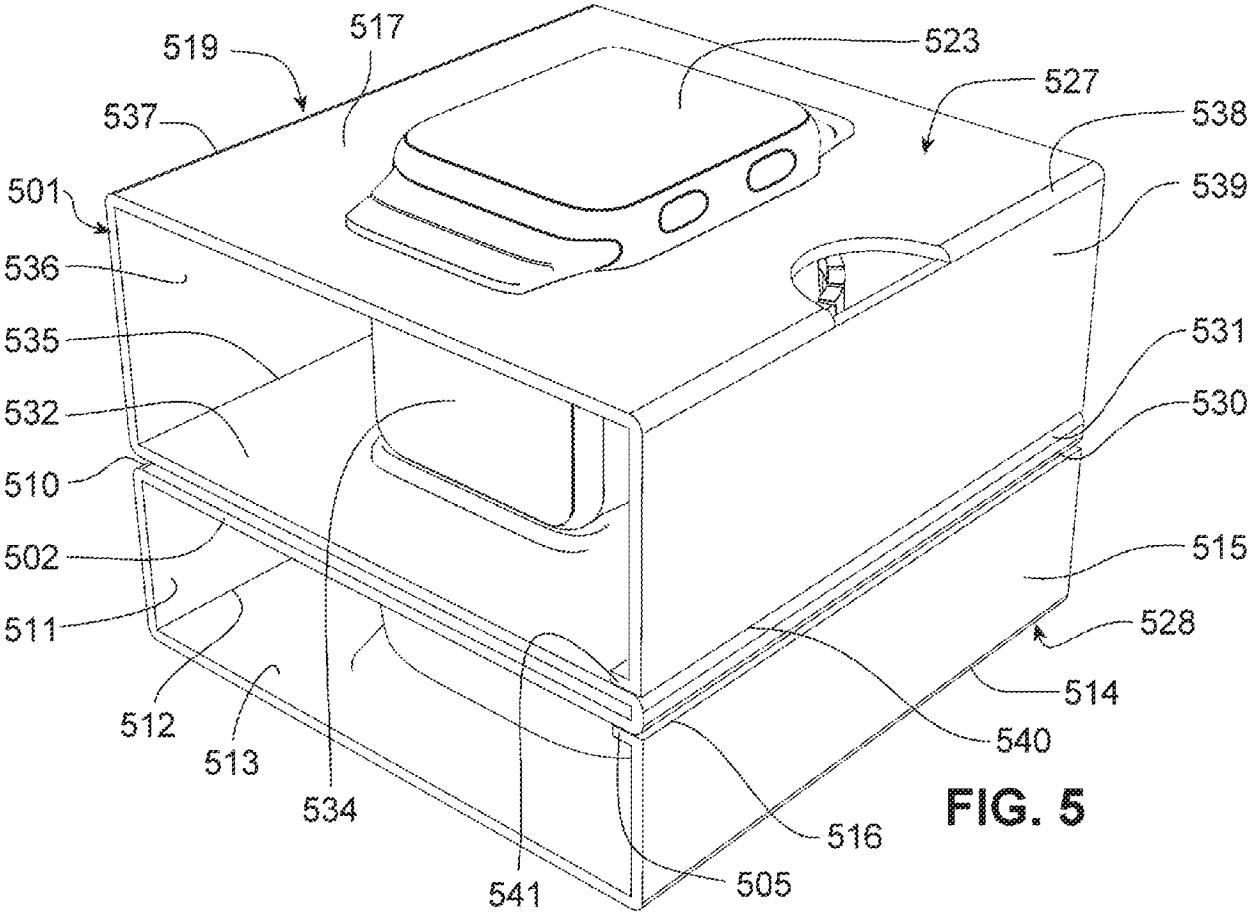
FIG. 5 shows a three-dimensional view of an alternative embodiment of a packaging element, according to some embodiments of the system described herein.
Figure 6:
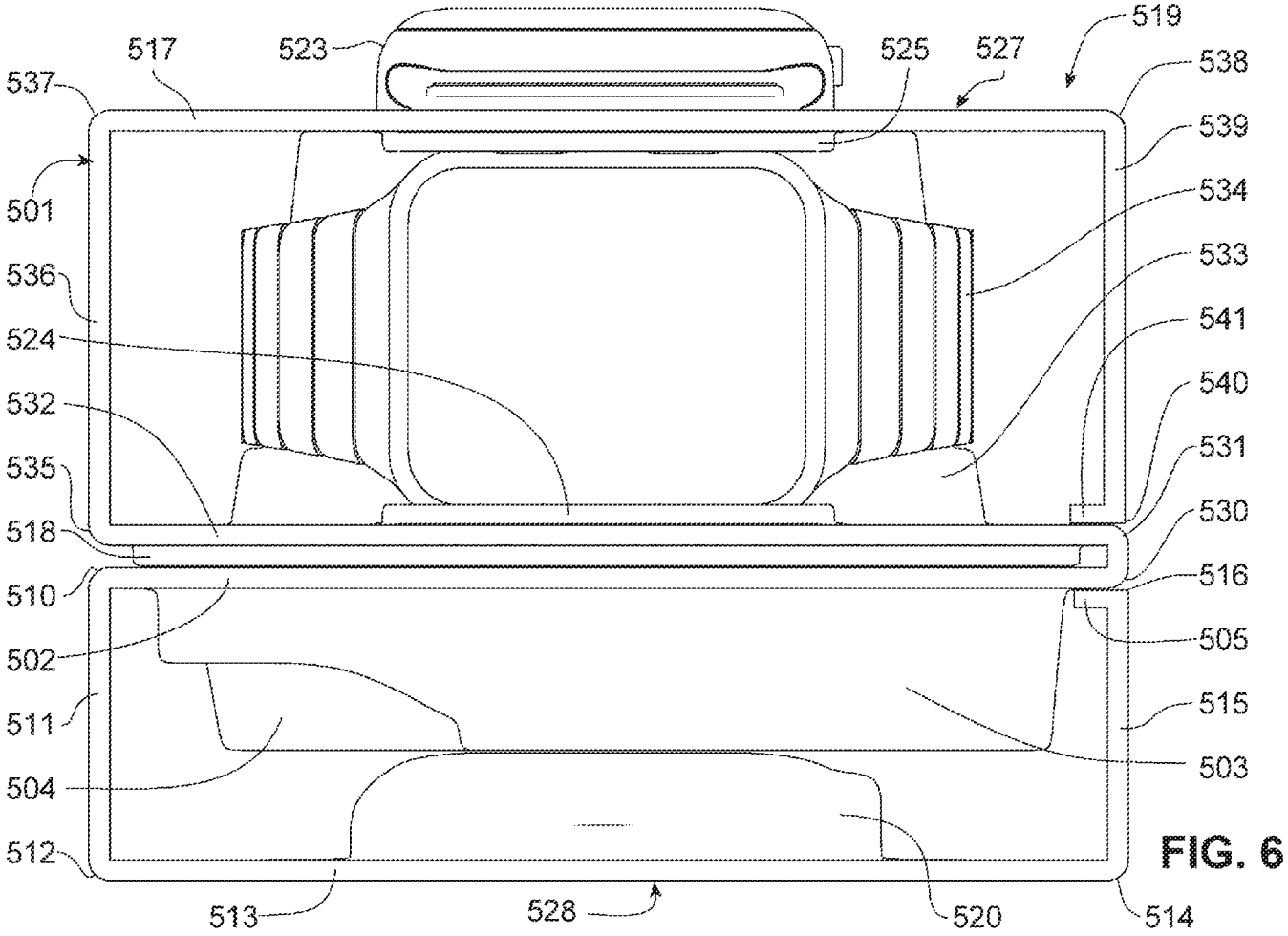
FIG. 6 shows a side view of the packaging element from FIG. 5, according to some embodiments of the system described herein.
Figure 7:
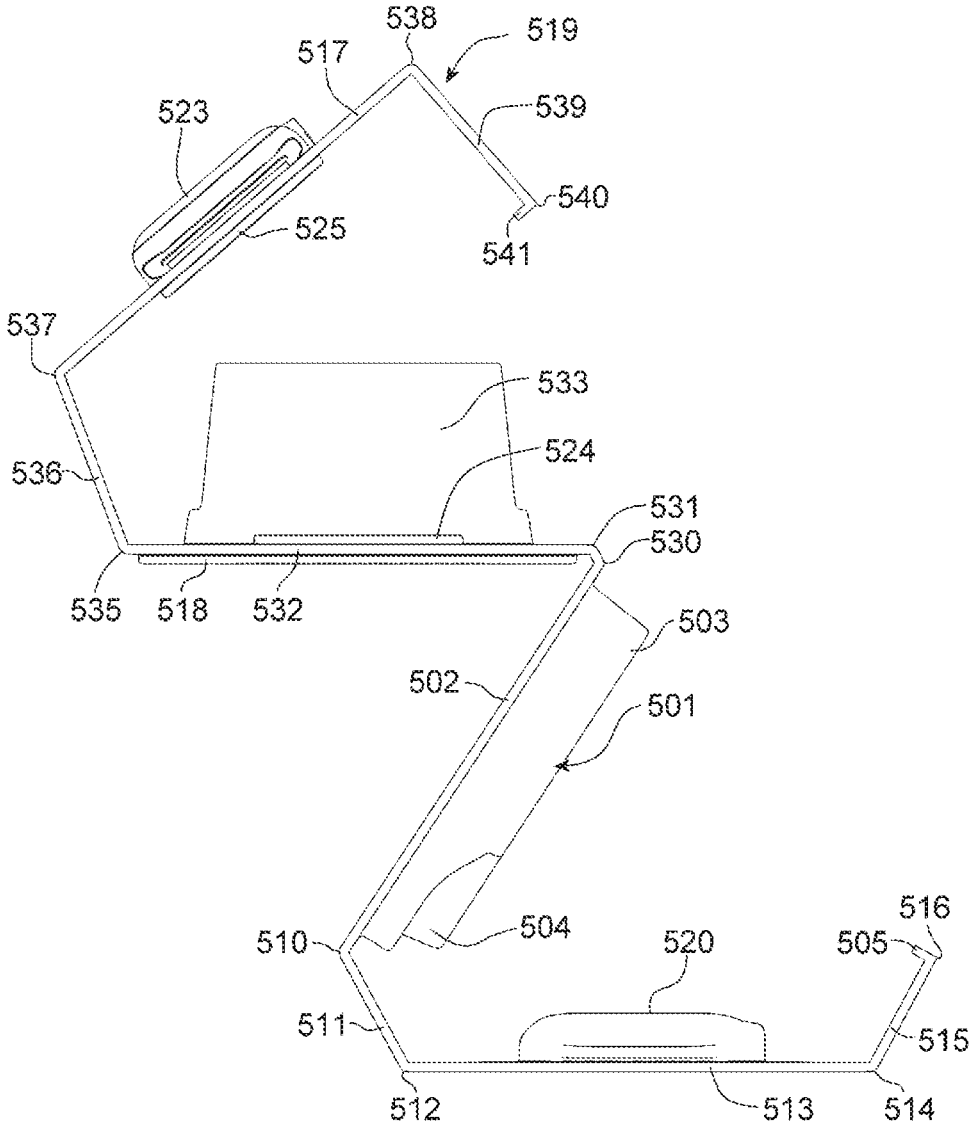
FIG. 7 shows a side view of the packaging element from FIG. 6 when pulled apart, according to some embodiments of the system described herein.

FIGS. 5-7 show an alternative embodiment of a packaging element 519 according to the system described herein. An important difference from the version described above resides in the fact that the packaging element 519 has an additional accommodating portion 532, which rests on the first accommodating portion 502. The two accommodating portions 502 and 532 adjoin each other via two folding lines 530, 531, so that they can be folded over through 180° relative to each other until they rest substantially on each other.

In a way similar to the embodiment described above, the first accommodating portion 502 has two shell-like depressions 503, 504, which each form a receptacle for accessories, for example a power unit or a headset. A first side-wall portion 511 adjoins the first accommodating portion 502 via a first folding line 510. It can be seen in FIG. 5 that the first side-wall portion 511 extends over only part of the height of the packaging element 519. A first cover-wall portion 513, in which the hollow 520 is formed, adjoins the first side-wall portion 511 via a second folding line 512. The second side-wall portion 515, which has a similarly wide extent to the first side-wall portion 511, adjoins via a further folding line 514. A first marginal web 505 adjoins the second side-wall portion 515 via a further folding line 516.

The second, additional accommodating portion 532 has on its underside a circumferential spacer rib 518, so that a certain distance prevails between the two main planes of the two accommodating portions 502 and 532.

As can be seen in FIGS. 5 and 6, the second accommodating portion 532 has a receptacle 533, which is formed as a protrusion projecting upward. The object 534 to be accommodated, in this case a digital wristwatch, is pushed onto the outer side of this protrusion 533. The additional accommodating portion 532 and the second cover-wall portion 517, extending above the accommodating portion 532 and parallel thereto, each have a fixing rib 524 and 525, which fix the object 534 to be accommodated in the folded-together position of the packaging element 519 that is illustrated in FIG. 6.

The additional accommodating portion 532 is adjoined via a folding line 535 by a further side-wall portion 536, which extends in the same vertical plane above the side-wall portion 511. The second cover-wall portion 517, in which the protrusion 523 is formed, which is formed so as to be substantially complementary to the hollow 520 of the first, lower cover-wall portion 513, adjoins via a folding line 537. In the folded-together state of the packaging element 519, illustrated in FIGS. 5 and 6, the protrusion 523 is located on the upper side 527 and the hollow 520 on the underside 528. In this way, a second identical packaging element 519 can be laid on the upper cover-wall portion 517 of a lower packaging element 519, the protrusion 523 on the upper side 527 of the lower packaging element 519 projecting into the hollow 520 on the underside 528 of the upper packaging element 519. The objects packaged in this way can be stacked on this side so as to be secure against displacement. It can be seen, in particular in FIG. 5, that the protrusion 523 has the shape of the packaged object 534. In this way, the packaging is enhanced visually and the object 534 packaged therein is presented attractively. A further side-wall portion 539 adjoins via a further folding line 538, once more a marginal web 541 at the end of this side-wall portion 539 likewise adjoining via a folding line 540.

In some embodiments, all the portions of the packaging element 519 are formed from a one-piece molded pulp blank 501, the different protrusions and hollows being formed in the molding. This packaging element can also be inserted into a carton, the upper side and underside of which each have a hole, the contour of which corresponds to the contour of the protrusion and of the hollow.

It is readily possible to insert further accommodating portions into the packaging, so that the packaging can be folded open substantially like an accordion with accommodating portions folded onto one another. In the embodiment described here, the side-wall portions 515, 539 located at the end of the blank each extend over only part of the height of the packaging element 519. Alternatively, one of these two side-wall portions 515, 539 can extend over the entire height of the packaging element 519. The second side-wall portion can then be omitted or, for example, folded back underneath the upper cover-wall portion 517.

The features of the system described herein disclosed in the present description, in the drawings and in the claims can be important both on their own and in any desired combinations for the implementation of the system described herein in its various embodiments. The invention is not restricted to the embodiments described. It can be varied within the context of the claims and whilst taking into account the knowledge of the appropriate person skilled in the art. Other embodiments of the invention will be apparent to those skilled in the art from a consideration of the specification and/or an attempt to put into practice the invention disclosed herein. It is intended that the specification and examples be considered as illustrative only, with the true scope and spirit of the invention being indicated by the following claims.

The invention claimed is:

1. A packaging element for accommodating at least one product, comprising:

a blank which has the following portions connected to one another by folding lines:

an accommodating portion having at least one receptacle, the shape of which is matched to the shape of a product to be accommodated;

a first side-wall portion;

a first cover-wall portion;

a second side-wall portion; and a second cover-wall portion, wherein the first cover-wall portion has at least one hollow, and the second cover-wall portion has at least one protrusion with a shape and position complementary to the hollow, wherein the packaging element has at least one additional accommodating portion with at least one receptacle, wherein at least one folding line extends between the accommodating portion and the additional accommodating portion, and wherein the additional accommodating portion rests on the accommodating portion.

2. The packaging element as claimed in claim 1, wherein the accommodating portion is enveloped by the two side-wall portions and the two cover-wall portions by folding along the folding lines.

3. The packaging element as claimed in claim 1, wherein the first cover-wall portion and the second cover-wall portion extend in mutually parallel planes.

4. The packaging element as claimed in claim 1, wherein the underside of a second identically shaped packaging element can be laid flush on the upper side of a packaging element, and wherein the protrusion on the upper side of the lower packaging element projects into the complementarily shaped hollow on the underside of the upper packaging element.

5. The packaging element as claimed in claim 1, wherein the at least one protrusion has the shape of a symbol.

6. The packaging element as claimed in claim 5, wherein the symbol is a logo, a number or a letter.

7. The packaging element as claimed in claim 1, wherein the packaging element consists of pulp fibers.

8. The packaging element as claimed in claim 7, wherein the packaging element is produced in accordance with one of the following methods:

in the molded pulp process;

by deep-drawing board or paper.

9. A packaging carton having a box-like holding carton, in which a packaging element is accommodated, the packaging element including:

a blank which has the following portions connected to one another by folding lines:

an accommodating portion having at least one receptacle, the shape of which is matched to the shape of a product to be accommodated;

a first side-wall portion;

a first cover-wall portion;

a second side-wall portion; and a second cover-wall portion, wherein the first cover-wall portion has at least one hollow that is a depression within the first cover-wall portion defining a three-dimensional space, and the second cover-wall portion has at least one protrusion with a shape and position complementary to the hollow and wherein the packaging carton has a lid in which the upper side of the lid has at least one hole, the shape and position of which corresponds to the shape and the position of the at least one protrusion of the adjacent second cover-wall portion, and in that the underside of the holding carton has a hole, the shape and position of which corresponds to the shape and the position of the at least one hollow of the adjacent first cover-wall portion.

10. A packaging carton having a box-like holding carton, in which a packaging element is accommodated, and having a lid, wherein the packaging element is for accommodating at least one product and includes a blank which has the following portions connected to one another by folding lines:

an accommodating portion having at least one receptacle, the shape of which is matched to the shape of a product to be accommodated;

a first side-wall portion;

a first cover-wall portion;

a second side-wall portion; and a second cover-wall portion, wherein the first cover-wall portion has at least one hollow, and the second cover-wall portion has at least one protrusion with a shape and position complementary to the hollow, and wherein the upper side of the lid has at least one hole, the shape and position of which corresponds to the shape and the position of the at least one protrusion of the adjacent second cover-wall portion, and in that the underside of the holding carton has a hole, the shape and position of which corresponds to the shape and the position of the at least one hollow of the adjacent first cover-wall portion.

* * * * *